US010208424B2

(12) United States Patent
Roselle et al.

(10) Patent No.: US 10,208,424 B2
(45) Date of Patent: Feb. 19, 2019

(54) FABRIC REFRESHING CABINET DEVICE

(71) Applicant: WHIRLPOOL CORPORATION, Benton Harbor, MI (US)

(72) Inventors: Brian Joseph Roselle, Fairfield, OH (US); Corey Michael Bischoff, Cincinnati, OH (US); Lieven Richard Deketele, Zulte (BE); Stefan H. Hollinger, Kornberg im Taunus (DE); Stephan James Andreas Meschkat, Bod Soden (DE); Andre Christian Convents, Diegem (BE)

(73) Assignee: Whirlpool Corporation, Benton Harbor, MI (US)

( * ) Notice: Subject to any disclaimer, the term of this patent is extended or adjusted under 35 U.S.C. 154(b) by 374 days.

(21) Appl. No.: 15/226,112

(22) Filed: Aug. 2, 2016

(65) Prior Publication Data

US 2016/0340821 A1 Nov. 24, 2016

Related U.S. Application Data

(63) Continuation of application No. 12/475,689, filed on Jun. 1, 2009, now abandoned.

(51) Int. Cl.

| | |
|---|---|
| ***D06F 58/20*** | (2006.01) |
| ***D06F 58/10*** | (2006.01) |
| ***D06F 58/26*** | (2006.01) |
| ***F26B 25/06*** | (2006.01) |

(52) U.S. Cl.

CPC ..... *D06F 58/203* (2013.01); *D06F 58/10* (2013.01); *D06F 58/26* (2013.01); *D06F 58/266* (2013.01); *F26B 25/06* (2013.01)

(58) Field of Classification Search

CPC ..... D06F 58/10; D06F 58/26; D06F 58/266; D06F 58/203; F26B 25/06

See application file for complete search history.

(56) References Cited

U.S. PATENT DOCUMENTS

| | | | |
|---|---|---|---|
| 1,865,103 | A | 6/1932 | Hill |
| 2,214,425 | A | 9/1940 | McNamara |
| 4,682,424 | A | 7/1987 | Irving |
| 5,085,358 | A | 2/1992 | Lam |
| 5,099,587 | A | 3/1992 | Jarosch |
| 5,305,484 | A | 4/1994 | Fitzpatrick et al. |

(Continued)

FOREIGN PATENT DOCUMENTS

| | | | |
|---|---|---|---|
| DE | 29713157 | U1 | 10/1997 |
| DE | 4435672 | C2 | 10/2000 |

(Continued)

*Primary Examiner* — Jessica Yuen

(74) *Attorney, Agent, or Firm* — Price Heneveld LLP

(57) ABSTRACT

A device for refreshing fabrics by reducing malodors and/or wrinkles without requiring that the fabrics to be put through an entire standard laundry process. The device comprises an extractable drawer which is pulled out of the device to allow for loading of a fabric into a receiving region. The extractable drawer can then be closed transporting the fabric into the interior of the device. A fabric treatment composition is sprayed or otherwise dispensed onto the fabrics when the device is operated. The device comprises an air flow path and a heating element which allows for the fabrics to be treated during use. The extractable drawer of the present invention can be positioned to extract laterally or vertically out of the shell of the device.

18 Claims, 6 Drawing Sheets

(56) References Cited

U.S. PATENT DOCUMENTS

| | | | |
|---|---|---|---|
| 5,344,054 | A | 9/1994 | Nutter |
| 5,369,892 | A | 12/1994 | Dhaemers |
| 5,511,701 | A | 4/1996 | Lam et al. |
| 5,560,124 | A | 10/1996 | Hart et al. |
| 5,664,710 | A | 9/1997 | Lam |
| 5,815,961 | A | 10/1998 | Estes et al. |
| 6,189,346 | B1 | 2/2001 | Chen et al. |
| 6,386,392 | B1 | 5/2002 | Argentieri et al. |
| 6,491,840 | B1 | 12/2002 | Frankenbach et al. |
| 6,495,058 | B1 | 12/2002 | Frankenbach et al. |
| 6,628,908 | B2 | 9/2003 | Matsumoto et al. |
| 6,726,186 | B2 | 4/2004 | Gaaloul et al. |
| 6,745,496 | B2 | 6/2004 | Cassella |
| 6,817,497 | B2 | 11/2004 | Grasso et al. |
| 6,840,068 | B2 | 1/2005 | Pasin et al. |
| 6,889,449 | B2 | 5/2005 | Silver |
| 6,925,737 | B2 | 8/2005 | Bolduan et al. |
| 6,964,360 | B2 | 11/2005 | Tubman et al. |
| 6,971,549 | B2 | 12/2005 | Leifheit et al. |
| 6,971,589 | B2 | 12/2005 | Incardona et al. |
| 7,043,855 | B2 | 5/2006 | Heilman et al. |
| 7,137,211 | B2 | 11/2006 | Johnson et al. |
| 7,140,121 | B2 | 11/2006 | Casella et al. |
| 7,308,990 | B2 | 12/2007 | Mazooji et al. |
| 7,328,822 | B2 | 2/2008 | Stokes |
| 7,367,137 | B2 | 5/2008 | Jonsson et al. |
| 7,739,891 | B2 | 6/2010 | Luckman et al. |
| 2004/0163184 | A1 | 8/2004 | Waldron et al. |
| 2005/0023310 | A1 | 2/2005 | Noda |
| 2005/0120757 | A1 | 6/2005 | Jackson |
| 2005/0257440 | A1 | 11/2005 | Seiffert et al. |
| 2005/0262671 | A1 | 12/2005 | Redlin |
| 2007/0020040 | A1 | 1/2007 | Sacks |
| 2007/0108310 | A1 | 5/2007 | Tollens et al. |
| 2007/0151120 | A1 | 7/2007 | Tomasi et al. |
| 2007/0151129 | A1 | 7/2007 | McAllister et al. |
| 2007/0151301 | A1 | 7/2007 | Kendall et al. |
| 2007/0151310 | A1 | 7/2007 | Wright et al. |
| 2008/0000616 | A1 | 1/2008 | Mobile |
| 2008/0256989 | A1 | 10/2008 | Jeong et al. |
| 2009/0038083 | A1 | 2/2009 | Roselle et al. |
| 2009/0126421 | A1 | 5/2009 | Kim et al. |
| 2009/0133298 | A1 | 5/2009 | Kim et al. |
| 2009/0241268 | A1 | 10/2009 | Yoo et al. |
| 2009/0241269 | A1 | 10/2009 | Yoo et al. |
| 2010/0043247 | A1 | 2/2010 | Park et al. |
| 2010/0186176 | A1 | 7/2010 | Wright et al. |

FOREIGN PATENT DOCUMENTS

| | | | |
|---|---|---|---|
| EP | 587173 | A1 | 3/1994 |
| EP | 670135 | A1 | 6/1996 |
| EP | 683999 | A1 | 4/2000 |
| EP | 812556 | A2 | 5/2000 |
| EP | 953669 | B1 | 9/2003 |
| EP | 1528145 | A2 | 5/2005 |
| EP | 1288367 | B1 | 8/2005 |
| GB | 2189522 | A | 10/1987 |
| GB | 2321954 | A | 8/1998 |
| GB | 2394271 | A | 4/2004 |
| JP | 10156096 | A | 6/1998 |
| JP | 11057299 | A | 3/1999 |
| WO | 9949123 | A1 | 9/1999 |
| WO | 0019001 | A1 | 4/2000 |
| WO | 02072940 | A1 | 9/2002 |

FABRIC REFRESHING CABINET DEVICE

CROSS-REFERENCE TO RELATED APPLICATION

This application is a continuation of and claims priority to U.S. patent application Ser. No. 12/475,689, entitled "FABRIC REFRESHING CABINET DEVICE," filed on Jun. 1, 2009, the entire disclosure of which is hereby incorporated herein by reference.

BACKGROUND OF THE INVENTION

Fabric treatment devices which are used to remove odors and wrinkles from clothing are known. These devices can generally be split into two categories, steam generating devices and fluid dispensing devices which wet the fabrics with water, chemical compositions, or combinations thereof. Devices of both categories typically wet the fabric with steam or the fluid, then subject the wetted fabric with heat and circulating air to allow the fabric to be dried, thereby decreasing any odors and wrinkles. Despite the many attempts to provide convenient stand alone devices for deodorizing and dewrinkling clothing, there remains a need to make devices which are time efficient, consume less space, and are easy to use.

The use of steam to deodorize and dewrinkle clothing is well known in the art. For example, U.S. Pat. No. 5,815,961 discloses a clothing treating machine comprising a steam generator located in the lower region of the fabrics housing; a fan and heating means are also provided to deliver hot air and/or ambient air into the interior of the device. Furthermore, weighted clamps and inflatable hangers can be used to assist in the removal of wrinkles. Devices of this type, however, have been found to have many drawbacks. The device typically heats a volume of water to boiling point, thereby generating steam. Heating the water to boiling point requires a considerable amount of energy and heat. Further, the heating device used by the apparatus requires a certain amount of time to reach the temperature required to heat the water to boiling temperature. Typically, the device does not activate the heating element until the user inserts clothing and turns the device on. This process typically takes an unacceptable amount of time. If the device were to continually heat a volume of water at or near boiling point, the amount of time needed to generate and circulate the steam within the device could be reduced. This option, however, is costly in terms of energy consumption. Additional techniques of using steam to deliver a fabric care composition onto the fabrics have also been attempted. Many fabric care compositions, however, are not suitable for being delivered onto fabrics via steam for a variety of reasons, including but not limited to difficulty in being vaporized into the steam, long evaporation times, and low rate of deposition onto the fabrics.

Another type of fabric treating device which distributes fluids, such as water and/or chemical compositions, onto the fabrics by misting within the device or distributing the fluid directly onto the fabrics. For example, U.S. Pat. No. 6,189,346 to Chen et al. distributes a chemical composition onto the fabrics in an allegedly "controlled manner" by generating a mist from a reservoir containing said chemical composition and circulating it within the device such that the fabric becomes purportedly "uniformly distributed". The chemical composition is dispensed within the cabinet interior region by combining it with the air stream under pressure provided by the compressor and passing it through the atomization nozzle. One known problem with this approach is that the mist may undesirably collect unevenly at certain portions of the fabrics depending on the flow of air within the device. Another problem is that the device may take an undesirably long amount of time to sufficiently wet the fabrics as the mist circulating within the device is difficult to control and direct onto the fabrics within the device.

Yet another type of fabric treating device involves the use of ultrasonic nebulizers to distribute the fluids onto the fabrics are known. See e.g. U.S. Pat. No. 6,726,186 to Gaaloul et al.; and U.S. Pat. No. 7,367,137 Jonsson et al. One problem with the use of ultrasonic nebulizers is that the ultrasonic nebulizers can become contaminated from contact with the treatment composition, thereby causing buildup on the spraying or misting portion of the ultrasonic nebulizer. Solutions to this problem include protective liquid or gel medium and a covering membrane but membranes are prone to be soft and easy to break making the approach using ultrasonic nebulizers has been found to offer limited usefulness. Another drawback to ultrasonic nebulizers is that the ultrasonic nebulizers are typically designed for low flow rates, such as low as 2 grams of fluid I minute per nebulizer head. Increasing the flow rates has been found to be problematic as increased flow through the nebulizer could result in insufficient fluid distribution. Further, the known techniques of distributing fluid via ultrasonic nebulizer have provided limited control. Also, these devices frequently have droplet coalescence which can impede the distribution when the ultrasonic nebulizer is positioned at the top of the device dispensing down onto the fabrics, and/or at the bottom of the device to dispense and/or mist upwards onto the fabrics. Another problem with top down and bottom up techniques is that they tend not to uniformly wet the fabrics, instead focusing mainly on the top or bottoms of the fabrics. Additional complex air circulation techniques are typically necessary to address these problems. The placement of sprayer heads in a perpendicular orientation to the plane of the fabrics has also been attempted. One problem with this approach is that the fabrics should be a certain distance away from the sprayer heads such that the fluid can be properly dispersed and not excessively concentrated on one spot as the spray occurs. Excessively wide devices raise a new set of problems as space efficiency is an important factor when the device is used in a domestic setting. One approach has been to position the sprayer heads on only one wall of the device such that they spray one side of the fabrics. The distribution of fluid, however, will be undesirably rich on one side of the fabrics where the sprayer is and poor on the opposite side.

Another problem related to these devices is that the way the device is opened to allow the user to access the area to hang or place the clothing. Devices which include a swinging door opening have a wide footprint and also require a large amount of space to allow the device to be accessed and used.

Despite these and other attempts to provide fabric refreshing devices, there remains a need for a device which addresses one or more of the above problems mentioned herein, yet is sufficiently time and energy efficient, minimizes space consumption, and is user friendly.

SUMMARY OF THE INVENTION

One aspect of the present invention provides for a device for treating fabrics comprising: a cabinet comprising: a shell which is preferably in the form of a non-collapsing cabinet comprising an opening; and an extractable drawer comprising: an drawer face comprising an outer surface; a supporting member such as a rod, pole, beam, hooks or other member capable of suspending a fabric or a fabric hung upon a fabric hanging member, wherein said drawer face and said supporting member form a receiving region adapted to operably support a fabric, and wherein said extractable drawer is adapted to fit within said shell; a heating element contained within said device; and an air flow path positioned to direct air through said receiving region. In one preferred embodiment, the device further comprises one or more dispensing heads positioned in the interior of the device to dispense the fabric treatment composition onto the fabrics contained in the receiving region. In another preferred embodiment, the device comprises one or more side protrusions formed in the sides of the shell, extending away from the device.

In yet another aspect of the present invention is provided a method of treating a fabric comprising placing a fabric into the receiving region of the device of the present invention; dispensing onto a fabric treatment composition upon at least a portion of said fabric; actuating said heating element; and venting said device to allow the air and fabric treatment composition to be vented away from the fabrics, thereby drying and refreshing the fabrics by removing wrinkles and/or malodors.

DETAILED DESCRIPTION OF THE INVENTION

Figure 1:
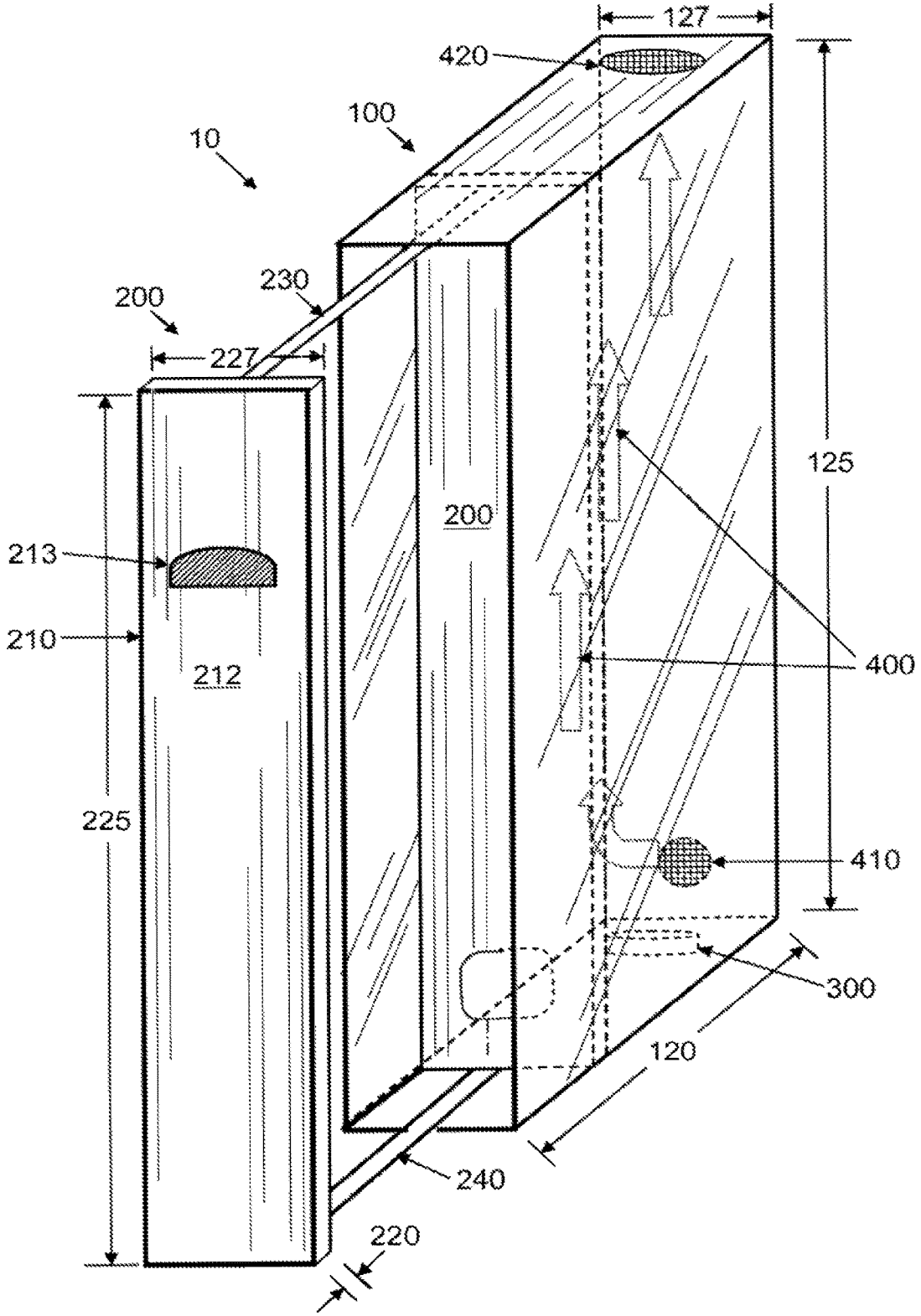
FIG. 1 is a perspective view of a device in accordance with at least one embodiment of the present invention wherein the extractable drawer is in a partially opened position.

The present invention provides for a device for treating fabrics comprising: a shell which is preferably in the form of a non-collapsing cabinet comprising an opening; and a extractable drawer comprising: a drawer face comprising an outer surface; a supporting member such as a rod, pole, beam, hooks or other member capable of suspending a fabric or a fabric hung upon a fabric hanging member such as a hanger, wherein said drawer face and said supporting member form a receiving region adapted to operably support a fabric, and wherein said extractable drawer is adapted to fit within said shell; a heating element contained within said device; and an air flow path positioned to direct air through said receiving region. It has importantly been found that the present invention provides users with a versatile device which can refresh, dewrinkle, and provide additional benefits to fabrics such as clothing and other textiles in a quick and efficient manner. Further, since the extractable drawer of the present invention provides users with a simple yet user friendly way to load the cabinet with fabrics without having to reach into the device and potentially touch or brush up against interior shell walls of the device which may have a greasy or filmy feeling residue left over from an earlier use. As used herein, fabrics include one or more items of clothing, garments, textiles, towels, table cloths, drapes, chair covers, and the like. As defined herein, "operably support" means that the suspending member is capable of directly supporting a fabric hung thereon, or of supporting a fabric hanging member which can have a fabric hung thereon.

In one embodiment, the device comprises a footprint which is compact in width such that the device can be used in a bedroom, closet or other living space where larger wider devices are inconvenient. The small footprint width of the present device is achieved from the extractable drawer design. The present invention occupies less horizontal floor space compared to devices which include a hinged door because the extractable drawer consumes the same or a smaller horizontal footprint compared to the shell of the cabinet compared to conventional hinged doors which include a wider footprint from the sweeping action of the hinged doors. As such, the present device is more compact and convenient to use in various rooms of the home. Further, the present device is believed to appear more streamlined than conventional devices and is suitable for use in varying rooms in a home and provides sufficient spray or misting capability to effectively wet the fabrics quickly, yet still achieves an effective distribution of the composition.

It has been determined that it may be desirable to construct the shell to have a larger peripheral size than the drawer face of the extractable drawer, when the device is viewed facing the drawer face of the expandable drawer. In one embodiment, at least one portion of the shell extends laterally or horizontally beyond the periphery of the drawer face of the extractable drawer, such as when the device is viewed in a frontal view. See e.g. FIG. 2. In one embodiment, one or both of the sides of the shell extend beyond the periphery of the drawer face of the expandable drawer. In yet another embodiment, the side portions of the shell further comprise one or more side protrusions which further extend beyond the periphery of the drawer face and provide greater lateral distance from the receiving region of the extractable drawer. By extending the lateral width of the device, the present invention is able to facilitate the inclusion of dispensing heads (including but not limited to sprayer heads, hydraulic nozzles, sonic or ultrasonic nebulizers, pressure swirl atomizers, high pressure fog nozzle, and combinations thereof) positioned at a desired distance from any fabrics contained within the device. Extending the periphery of a portion of the shell beyond the periphery of the drawer face of the extractable drawer allows the device to increase the distance between the dispensing heads to the fabrics without requiring that the entire device be made to have an unnecessarily large width. Further, by minimizing the width of the drawer face, yet providing for a shell which extends laterally or horizontally beyond the periphery of the device, or one or more side protrusions, the device appears thinner, yet can still achieve sufficient composition distribution onto the fabrics.

Figure 10:
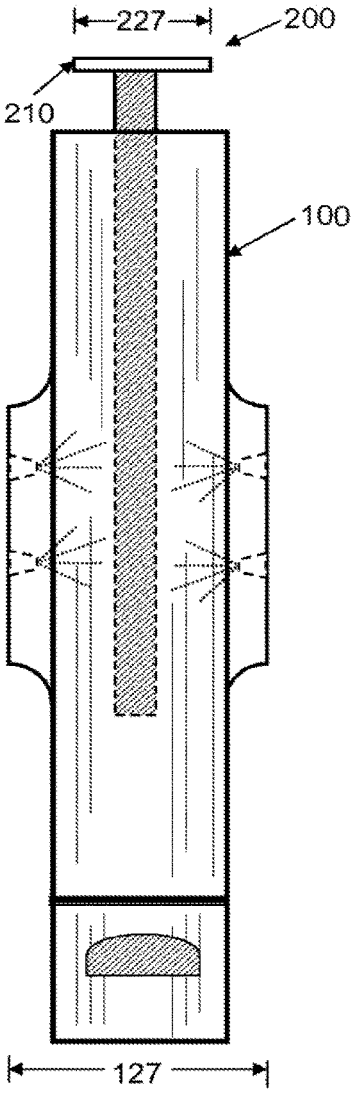
FIG. 10 is a frontal view of a device in accordance with at least one embodiment of the present invention, wherein the extractable drawer extends out vertically.

FIG. 1 is a perspective view of a device 10 for treating fabrics comprising a shell 100 forming at least one opening, wherein the extractable drawer 200 is in a partially opened position. In this embodiment, the extractable drawer is shown as a frontal drawer which can be pulled out or actuated out of the opening formed in said shell via any suitable mechanical or manual means. Non-limiting examples of mechanical means to extract the drawer include spring loaded drawers, a chain driven drawers, and levered drawers. In another embodiment, the extractable drawer can be positioned to exit the shell in an upwards or vertical direction as opposed to a lateral or horizontal direction. See FIG. 10 compared with FIG. 1. In one embodiment, the extractable drawer comprises one or more sliding members such as a wheel or glide with or without roller bearings, which can be adapted to slide along a rail provided from said shell. In one embodiment the shell is a non-collapsing member comprising a pair of side walls, a top, a front wall, a rear wall and a base wall, wherein at least a portion of one of said top, front wall and rear wall can be formed from said drawer face of said extractable drawer. The extractable drawer 200 comprises a drawer face 210 having an outer surface 212. In one embodiment, said drawer face at least partially seals said opening of said shell in a closed position. Where the drawer face does not fully seal the opening of said shell, a gap in the seal can perform the function of an inlet and/or outlet vent in the venting system of the device. In another embodiment, the drawer face fully seals said shell in a closed position. In yet another embodiment, the outer surface of the drawer face forms a flush closure with the shell. The extractable drawer is shown with an optional handle 213 for accessing the extractable drawer from the interior of the shell. The extractable drawer further comprises a supporting member 230 which can operably support one or more fabrics, said drawer face supporting member form a receiving region for said fabric Suitable supporting members include a rod, pole, beam, rope, cord, or hooks extending from the drawer face into the interior of the shell. In one embodiment, the supporting member further comprises a hook or notch to support a fabric hanging member such as a hanger. In another embodiment, the supporting member supports a hanger fixedly or removably attached to said supporting member. In another embodiment, the supporting member further comprises a telescoping section which allows the supporting member to be extended or retracted. In one embodiment, the device further comprises a tensioning system which can assist in the removal of wrinkles from the entire fabric or a discrete section of the fabric. In one embodiment, the tensioning system is provided by the hanger in conjunction with the extractable drawer. Suitable tensioning devices known in the art include expanding hangers, hanging weights or poles or rods which can be used to drape or stretch the fabrics over and/or around. Additional non-limiting examples of tensioning systems are disclosed below.

The extractable drawer is shown with an optional rear face 220 and an optional base 240. In this position, the rear face is contained within the shell such that the extractable drawer is not fully detached from the device. In one embodiment, the extractable drawer is a fully detachable drawer meaning that it can be removed from the shell. In another embodiment, the extractable drawer is movable but attached to the shell such that the extractable drawer can be slidably contained within the shell but cannot be completely removed. The drawer face 210 is shown connected to said rear face 220 by said supporting member 230. Although the supporting member shown in FIG. 1 is shown attached to both the drawer face and the optional rear face, the supporting member can be connected to either of the drawer face or the optional rear face. Alternately, the supporting member may be hingedly attached to either of the drawer face and the rear face. One important benefit obtained by providing a rear face which fits within the interior space of the shell, the user is limited in exposure to the condition of the side walls or any tubes or wires provided therein. It is believed that upon repeated use, the interior of the side walls can collect residue or buildup from the fabric treatment composition sprayed or misted within the device and evaporated from the fabrics. By providing a rear face in the extractable drawer, the user exposure to the interior of the side walls is limited. Further, the rear face adds an aspect of safety as the user cannot access any tubes, hoses, wires or electronics contained with the shell. The device shown in FIG. 1 further comprises a heating element 300 and an air flow path 400. When the extractable drawer is in a closed position, the air flow path directs at least a portion of the air to and/or through the receiving region. The heating element can be positioned within the shell at any location which allows the heating element to transfer heat, either through convection, conduction, or radiation, to the interior of the shell, particularly to the receiving region, more particularly to any fabrics contained within the receiving region. Suitable heating elements include heating wire or coil, an infrared lamp, a microwave heating element, and combinations thereof. In this embodiment, the heating element 300 can be provided to be flush with the lower portion of the shell such that it does not obstruct the closing of the extractable drawer when the rear face is moved towards the back of the shell.

The air flow 400 is facilitated by a venting system comprising an inflow vent 410 and an outflow vent 420. In one embodiment, the inflow vent is positioned below the outflow vent. This is believed to allow for natural convection and movement of the heated air to escape without the need for active air flow. In another embodiment, the inflow vent is poisoned above the outflow vent. Air flowing from the inflow vent to the outflow vent can be by natural convection or via forced draft. In the case of forced draft, a fan or other forced air movement means can be inserted in the air flow path. Preferably the fan is near the inflow vent 410 or the outflow vent 420 in order to avoid interference with the sliding door mechanism. The air flow means can be of any design but typically will be a fan of radial, centrifugal, or crossflow blower design as needed to achieve the desired flow rate.

In one embodiment, the outflow vent comprises an air filter system such as a charcoal filter. The air filter system can be used to capture malodors from the treated fabrics or interior of the device and/or used to capture excessive fragrance or perfumes provided from the fabric treatment composition. Without intending to be bound by theory, it is believed that by providing an air filter system in the outflow vent, any malodors released from the fabrics will not be released into the ambient air surrounding the device. This is particularly desirable when the device is used in the home in the bedroom or other rooms where the released malodors may be noticeable. The air filter system is preferably replaceable. In another embodiment, the outflow vent comprises a chemical capture member to remove moisture and/or other materials from the effluent. In another embodiment, the device further comprises an air filtering and/or treatment system. In one embodiment the inflow vent can be positioned below the outflow vent such that cool ambient air can be sucked into the shell by the movement of the heated air within the device (heated by the heating element 300). The heated air moving up the receiving region will pass over and through any fabrics located in the receiving region allowing the fabrics to dry. Without intending to be bound by theory, it is believed that the heat allows for control or killing of certain microorganisms and bacterials as well as removal of odor causing entities which can be present on the fabrics. This anti-microbial benefit is believed to be the result of subjecting the fabrics to a sufficiently high temperature to control, remove, and possibly kill the microorganisms and/or bacterias. In one embodiment the air treatment (freshening, deodorizing, disinfecting, etc.) system is part of or, provided in the vicinity of, the outflow vent such that air expelled from the device carries with it air treatment ingredients. Non-limiting examples of suitable liquid active materials comprise perfumes, air fresheners, deodorizers, odor eliminators, malodor counteractants, household cleaners, disinfectants, sanitizers, repellants, insecticide formulations, mood enhancers, aroma therapy formulations, therapeutic liquids, medicinal substances, or mixtures thereof. These and other suitable actives are disclosed in U.S. Ser. No. 11/273,461. In one embodiment, the device allows the consumer to manually or automatically determine the dosage rate and/or frequency of doses for emitting the air treatment composition. Although the air treatment device can be part of the outflow/venting system (such as by using the expelled air to emit the air treatment ingredients) the air treatment device can also be a separate element from the outflow venting system.

Those of skill in the art will understand that where a vent or heating element is provided in the device in the vicinity of the rear face when the device is in a closed or operating position, the rear face is designed such that air and/or heat can pass through the one or more apertures formed in the rear face to enter the receiving region and fabrics supported within the device. As such, in one embodiment, the rear face comprises one or more apertures positioned to facilitate the passage of the air through said air flow, and to allow heat to enter the receiving region and to exit the device with any evaporated fabric treatment composition and malodors. Further, where internal parts such as wires and dispensing heads are provided in the interior of the device, the rear face is operably designed such that upon opening and closing the extractable drawer, the rear face does not strike any internal parts of the device. In yet another embodiment, the opening or closing of the extractable drawer further actuates other elements which would allow the device to begin running.

The device depth 12 (not shown) which can be calculated by measuring the total depth of the device when the extractable drawer is in a closed position within the shell. In one embodiment, where the drawer face does not recede into the shell, the device depth would be equal to the sum of the shell depth 120 and the drawer face depth 220. Where the drawer face recedes into the shell such that the outer surface of the drawer face is flush with the shell, the device depth is equal to the shell depth 120. In one embodiment, the device depth is from about 24 inches to about 60 inches, alternatively from about 30 inches to about 48 inches, alternatively from about 36 inches to about 42 inches. The shell also comprises a height 125. Further, as shown in this embodiment, the shell has a width 127 and the drawer face has a width 227. In one embodiment, the device has a greatest lateral width of less than about 28 inches, alternatively less than about 20 inches, alternatively less than about 16 inches, alternatively less than about 12 inches. As defined herein, the greatest lateral width is determined when the device is viewed in a frontal view. The greatest lateral width can be measured at the base, the shell or any protrusions extending away from the shell, or the drawer face of the extractable drawer, depending on which element has the greatest width. In one embodiment, the device comprises a width ratio, as defined by the ratio of the greatest lateral width of the device to the greatest lateral width of the drawer face of the extractable drawer, of from about 9 to about 1, alternatively from about 4 to 1.2, alternatively from about 2 to 1.5. Importantly, it has been found that by providing a device having said width ratio of less than about 2 provides the desired appearance that the device has the general width of the door, yet allows for an increase in the distance from the fabrics located in the receiving region to the position of the sides of the device where the dispensing heads are located.

In one embodiment the device comprises a footprint aspect ratio of from about 1 to about 30, alternatively from about 2 to about 15, alternatively from about 3 to about 10, alternatively about 5. The footprint aspect ratio is a ratio of the greatest lateral length of the device 12 to the greatest lateral width of the device, such as from the optional base stand or the shell width. It has surprisingly been found that the present invention is versatile and can be suitably placed in many different areas when used in a domestic capacity. For example, the present device can be placed alongside a conventional washer and/or dryer device when used in the laundry area of a home. Importantly, by providing a device which has a footprint aspect ratio as defined herein, the device is versatile and can be used and fit into small spaces such as in the bedroom or other living area, along side a wall or within a closet. The device can be placed alongside a cabinet, dresser, TV stand, or couch. Importantly, when the device is opened, the footprint width does not increase. Devices which include one or more hinged doors or releasably sealed openings, such as by zipper, attached to a cabinet require larger footprint widths because the doors or openings tend to swing or drape beyond the width of the device when in an open position. It is believed that by providing a device having the dimensions as defined herein, the appearance of the device is considerably less obtrusive compared to fabric treatment and refreshing devices disclosed in the art. It is also believed that by providing a device having the dimensions as defined herein, the device will be more readily and conveniently used in the bedroom or other living areas, making the device more readily accessible to a user during the act of dressing, undressing, changing-clothes and the like.

Figure 2:
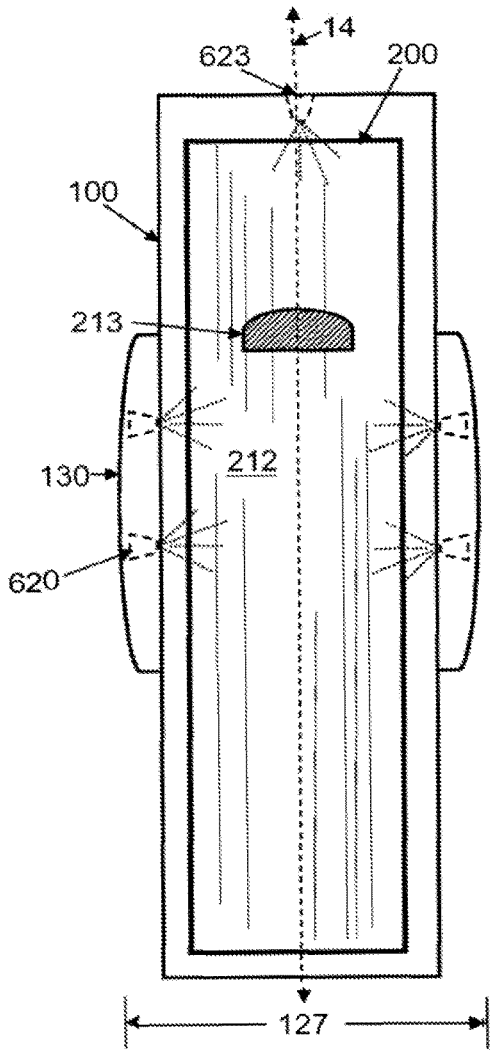
FIG. 2 is a frontal view of a device in accordance with at least one embodiment of the present invention, wherein the extractable drawer is in a closed position.

FIG. 2 is a frontal view of a device in accordance with the present invention, wherein the extractable drawer 200 is in a closed position. The shell 100 can comprise a larger width than the drawer face of the extractable drawer. In one embodiment, the device further comprises one or more protrusions extending beyond the frontal planar periphery of the drawer face 210. In this embodiment, the protrusion comprises the shell 100, shown having a larger width, height than the drawer face. In addition, FIG. 2 shows two additional side protrusions 130 formed on the side walls of the shell. As such, the shell width 127 is now measured as the widest lateral distance between the two points on opposing sides of the shell when measured on a plane perpendicular to the center line 14 of the device. As defined herein, the center line is the central axis of the device. The side protrusions can be provided in a variety of suitable shapes which allow for a slight increase in the distance between dispensing heads and suspended fabric.

The device of the present invention further comprises a plurality of dispensing heads 620 positioned on the side walls of the shell 200. In one suitable embodiment, the dispensing heads comprises one or more sprayer heads and optionally one or more ultrasonic nebulizers. Dispensing heads are preferred where the flow rate of the fabric treatment composition is desired to be high, for example greater than 2 grams of fluid per minute per nozzle. Non-limiting examples of suitable dispensing heads and sprayer heads are provided in U.S. Ser. No. 61/163,924 to Meschkat et al, filed Mar. 28, 2009. In one embodiment, where the device comprises one or more of said side protrusions 130, one or more of the dispensing heads 620 can be positioned on the interior of the side protrusion to increase the lateral distance between the head 620 and any fabric contained within the receiving region. Those of skill in the art will understand that by providing two or more sets of dispensing heads positioned on each side wall of the shell, the fabric can be wetted in a faster more efficient manner. Further, by increasing the horizontal distance between the dispensing heads and the fabric, the dispensed fluid has more space to disperse and cover more area on the fabric.

In one embodiment, the device comprises a lateral distance between the receiving region where a fabric is placed (which can be determined as the central line or axis 14 of the device) and at least one dispensing head positioned on either a side wall of the shell or on a side protrusion of less than about 12 inches, alternatively less than about 8 inches, alternatively less than about 6 inches and at least about 4 inches, alternatively at least about 6 inches, alternatively at least about 10 inches. FIG. 2 further shows an optional dispensing heads 623 positioned at the top of the shell, oriented to spray downwards onto any fabric within the device. Additional spray heads can be placed throughout the interior of the device such as on the interior portion of the drawer face or rear face, or base 240 where the dispensing heads are preferably situated for maximum fabric coverage, avoiding spray interference by any of the supporting members. In one embodiment where the dispensing heads comprise one or more sprayer heads, the sprayer heads preferably comprise one or more spray nozzles, such as 2, 3 4, or 6 spray nozzles. Multiple sprayer nozzles in the sprayer head allow for effective distribution of a benefit composition directly to a garment to be treated to minimize application time. Dispensing of a benefit composition can be achieved using any suitable device such as a hydraulic nozzle, sonic or ultrasonic nebulizers, pressure swirl atomizers, high pressure fog nozzle or a combination thereof, to deliver target particle sizes and coverage pattern. Non-limiting examples of suitable nozzles include nozzles commercially available from Spray Systems, Inc. such as Spray Systems, Inc. of Ponoma, Calif., under the Model 40 Nos.: 850, 1050, 1250, 1450 and 1650. Another suitable example of a spray head or nozzle is a pressure swirl atomizing nozzle made by Seaquist Dispensing of Gary, 111 under the Model No. DU3813.

Discharge nozzles can act as a fluid atomizing nozzle, using either a pressurized spray, or a dual fluid nozzle using air assist. Pressurized spray nozzles have an advantage of not requiring high pressure air to assist atomization of the treatment fluid. Special nozzle designs can be employed as well, for example utilizing a high voltage power supply to act as an electrostatic spray nozzle.

Suitable spray heads can be solitary nozzles or a compound nozzle containing more than one nozzle. In one preferred embodiment there are 4 spray heads housed within a side protrusion on each side of the device with each spray head comprising 4 individual spray nozzles that are mounted in a dome shaped housing. Nozzle design typically will be chosen in conjunction with the shell design. If no side protrusion or a thin side protrusion is desired, a nozzle providing a wider angle of spray is typically used to get broad coverage where there is a short distance to the garments to be treated. A wider protrusion distance can facilitate a nozzle with a slightly narrower angle of spray to achieve acceptable coverage.

Nozzle flow rates can vary depending on the number of nozzles utilized. Typically the nozzle flow rate times the number of nozzles times the spray time will produce the desired amount of benefit composition to be applied. In a preferred mode the total spray time is less than about 200 seconds, more preferably less than about 100 seconds and even more preferably less than about 10 seconds. In one preferred embodiment where there are a total of 8 compound nozzles of 4 individual nozzles each, the spray time utilizing a small pump and pressure swirl nozzles, is about 2 seconds with a total benefit composition sprayed of up to about 10 grams, alternatively up to about 25 grams, alternatively up to about 50 grams, alternatively up to about 100 grams. Those of skill in the art will understand that by increasing the number of spray nozzles in the device, the total device flow rate can be increased, for example one spray nozzle can provide an increase of about 1 gram per second. In addition to the spray heads, the device can also comprise one or more ultrasonic nebulizers, such as those known in the art Optionally, the benefit composition may be heated prior to spraying. Pre-heating the benefit composition prior to spraying may be accomplished by any heating element such as a heating wire or coil, an infrared lamp, microwave heating, radiative heating or heating-means known to one of skill in the art.

Figure 3:
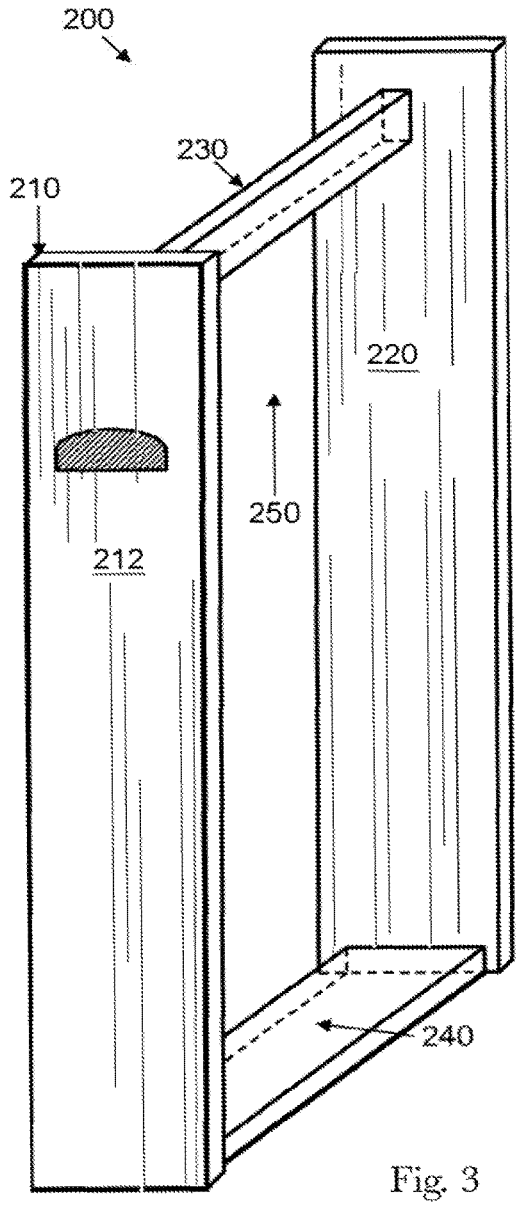
FIG. 3 is a perspective view of extractable drawer which is suitable for use any shell disclosed herein, to form a device in accordance with at least one embodiment of the present invention.

FIG. 3 is a perspective view of extractable drawer 200 for use with a device in accordance with at least one embodiment of the present invention. The extractable drawer comprises a supporting member 230 such as in the form of a rod, pole or beam, attached to both said drawer face 210 and said optional rear face 220. In one embodiment, the extractable drawer comprises a single hanging member, in another embodiment, multiple supporting members are provided, such as in the form of multiple supporting members. In another embodiment, the device further comprises one or more fabric hanging members supported by said supporting member. Said fabric hanging members are preferably removably attached to said supporting member by a hook, snap on fitment, or other suitable mechanism to allow the fabric hanging member to be supported on said supporting member while positioning the fabrics within the receiving region. In another embodiment, said one or more fabric hanging members are permanently attached to said supporting member. In another embodiment, said one or more fabric hanging members are hingedly attached to said supporting member.

As explained herein, the optional rear face can form a generally snug fit with the interior dimensions of the shell such that a user cannot access any components behind the rear face when the extractable drawer is fully extended in an open position. Those of skill in the art will understand that the rear face should not occupy the exact internal dimensions of the shell where wires, tubes, hoses, dispensing heads, vents, or other internal elements are required to run within the shell alongside the side walls or in the back of the shell. Further, where the device comprises one or more side protrusions, the side protrusions would also extend laterally beyond the dimensions of the rear face such that any dispensing heads contained within the side protrusion are not unduly contacted by the moving rear face. In one embodiment, where the back of the shell comprises one or more of said vents of said venting system, the rear face can be operably designed to include apertures to allow air passing through said vents to pass into the receiving region of the extractable drawer. Further, the extractable drawer comprises a base 240. The base can have the same width as the drawer face or a smaller width. In one embodiment, the base comprises a hole to allow exposure to any heating element provided below the extractable drawer, and/or a channel to facilitate heated air flow either by natural or forced draft convection.

Figure 4:
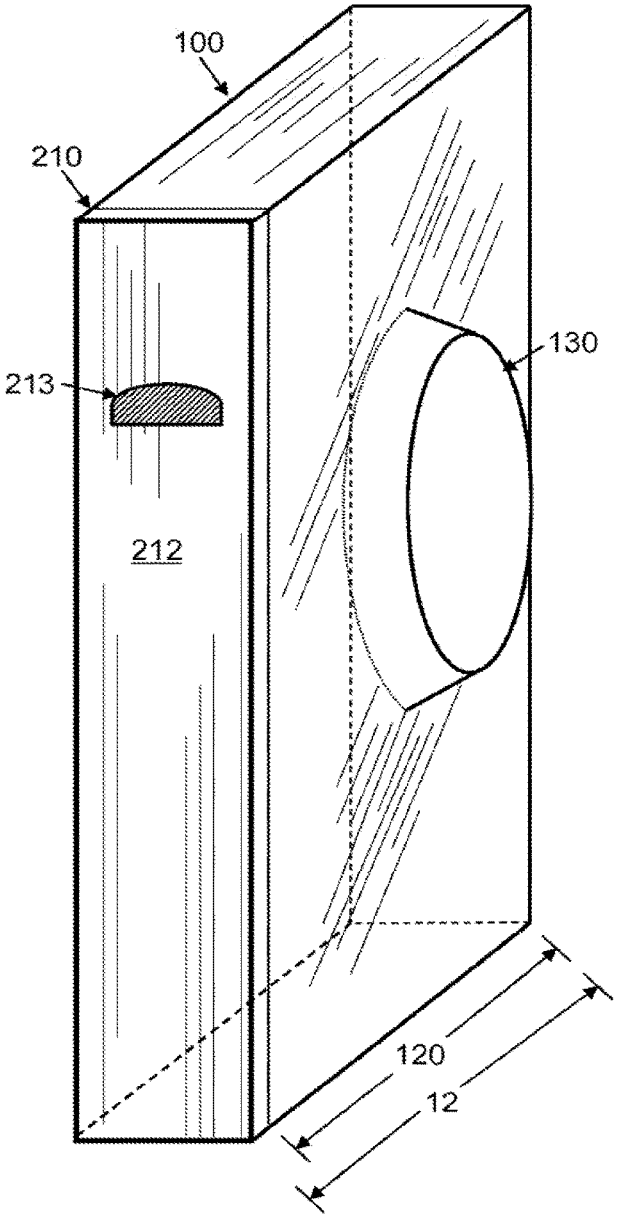
FIG. 4 is a perspective view of a device in accordance with at least one embodiment of the present invention.
Figure 6:
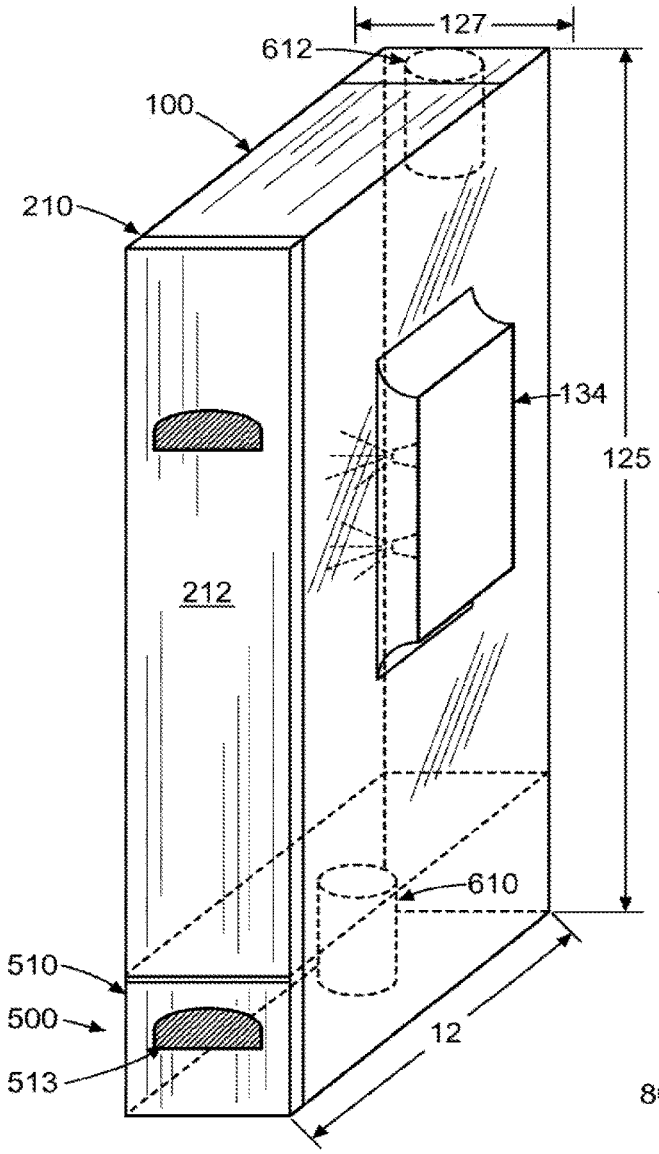
FIG. 6 is a perspective view of a device in accordance with at least one embodiment of the present invention.

FIG. 4 is a perspective view of a device in accordance with at least one embodiment of the present invention. In this embodiment, the side protrusions 130 are shown having an arcoidal shape. Suitable shapes for the side protrusions include any prism shape, such as a rectangle, square, or other polygon (as shown in FIG. 6); or an arcoidal shape, such as a circle, oval, or ellipse. FIG. 4 is shown have a device depth 12 which is the depth of the device in a closed position. As shown in this embodiment, the device depth can be the sum of the depth of the drawer face and the shell. In another embodiment, where the drawer face 210 of the extractable drawer rests flush to the rest of the shell, the device depth is generally equal to the shell depth 120 (unless the outer surface of the drawer face further comprises any elements which extend outwards such as a drawer handle 213.)

Figure 5:
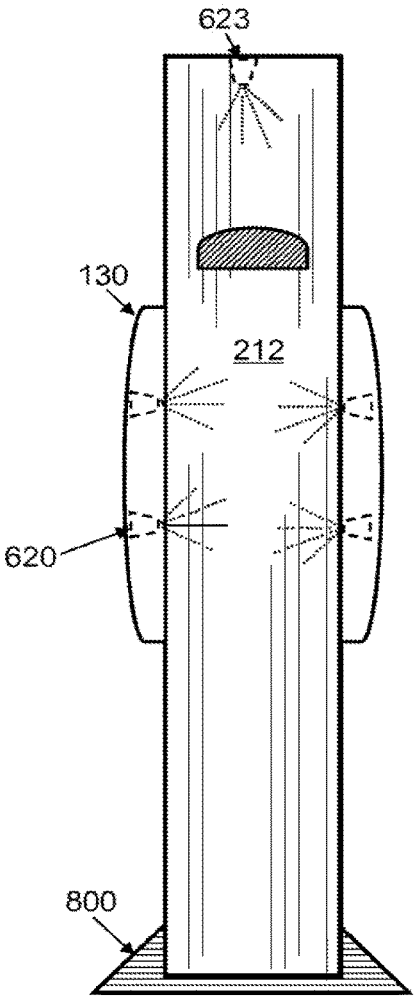
FIG. 5 is a frontal view of a device in accordance with at least one embodiment of the present invention.

FIG. 5 is a frontal view of a device in accordance with at least one embodiment of the present invention. The device of FIG. 5 is similar to the device of FIG. 4 except that FIG. 5 further comprises a base stand 800. In embodiments comprising a base stand, the footprint width of the device is the larger of either the greatest width of the drawer face or shell, or the greatest width of the base stand. In this embodiment, the footprint width would be measured as the greatest width of the base stand. FIG. 6 is a perspective view of a device in accordance with at least one embodiment of the present invention. FIG. 6 shows a side protrusion having a rectangular or quadrilateral shape such as a squared or rectangular prism shape 134. FIG. 6 further comprises a second extractable drawer 500 comprising a second drawer face 510.

In one embodiment, the extractable drawer is recessed into the interior of the shell. A hinged outer shell door can be provided to further enclose the extractable drawer within the shell. Optionally, this outer shell door can include an aperture where the knob or handle of the extractable drawer is exposed such that a user can pull the knob or handle and in one single motion hingedly open the outer shell door and extract the extractable drawer. In one embodiment, the knob or handle protrudes out of the aperture in the outer shell door.

The device of the present invention preferably contains a source of a fabric treatment composition. In one embodiment, the source of fabric treatment composition comprises a reservoir 610 positioned in the second extractable drawer 500 or a reservoir 630 positioned in the upper portion of the shell. Where the reservoir is positioned in the second extractable drawer, the reservoir can be accessed by pulling out the second extractable drawer. Where the reservoir is positioned in the shell forming the upper extractable drawer, an opening in the shell can be provided to allow access to the reservoir. The reservoir for a fabric treatment composition is operably connected to said one or more dispensing heads provided within said device, wherein said one or more spray heads are oriented to dispense said fabric treatment composition towards said receiving region. Importantly, the reservoir can be a refillable or replaceable reservoir.

In another embodiment, said source of said fabric treatment composition comprises: a reservoir for a fabric treatment composition, operably connected to a plurality of dispensing heads provided within said device; a detached spray member; a fluid transport member operably connected to a building piping system; and a combination thereof. Suitable detached spray members include known hand spray products, such as FEBREZE® fabric spray, DOWNY® Wrinkle Release sprayers or any other commercially available spray apparatus, such as starch sprays or bottled perfume sprays, or aerosol can products, such as FEBREZE® Air Affects. Suitable detached spray member sizes include 12 oz. containers and 27 oz. containers. The detached spray member can be a bottle which can be provided separate from the device or can be removably attached to the device such as in a bottle stand. In one embodiment, where the user desires just to wet the fabric with water, the source of the fabric treatment composition can be provided from another device such as a laundry machine or a faucet in the home. Suitable sources of fabric treatment composition include fluid dispensing systems as disclosed in U.S. Ser. No. 61/099,602 to Smith et al, filed Sep. 24, 2008 and U.S. 61/138,539 to Smith et al, filed Dec. 18, 2008.

Figure 7:
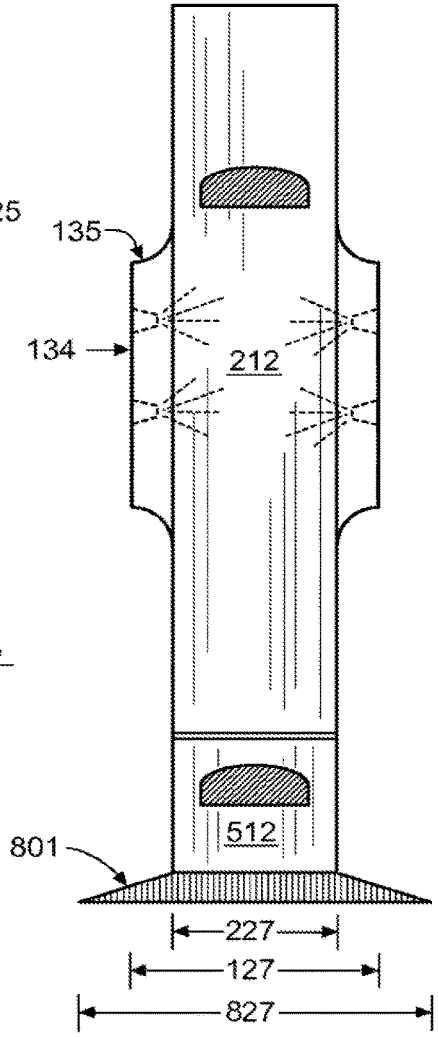
FIG. 7 is a frontal view of a device in accordance with at least one embodiment of the present invention.

FIG. 7 is a frontal view of a device in accordance with at least one embodiment of the present invention. This device is similar to the embodiment shown in FIG. 6, however the side protrusions are shown having a concave curved interface 135 between the side protrusion 134 and the side wall. Further, FIG. 7 is supported atop an optional base stand 801, said optional base stand creating a footprint width 827 which is greater than the drawer face width 227. The optional base stand provides increased stability against overturning especially in light of the footprint aspect ratio. In this embodiment, the greatest lateral width of the device is the width of the optional base stand 827 which is shown as being greater in width than the width of the portion of the shell forming the side extensions. Where the optional base stand is removed or not provided, the greatest lateral width would be the shell width 127.

Figure 8:
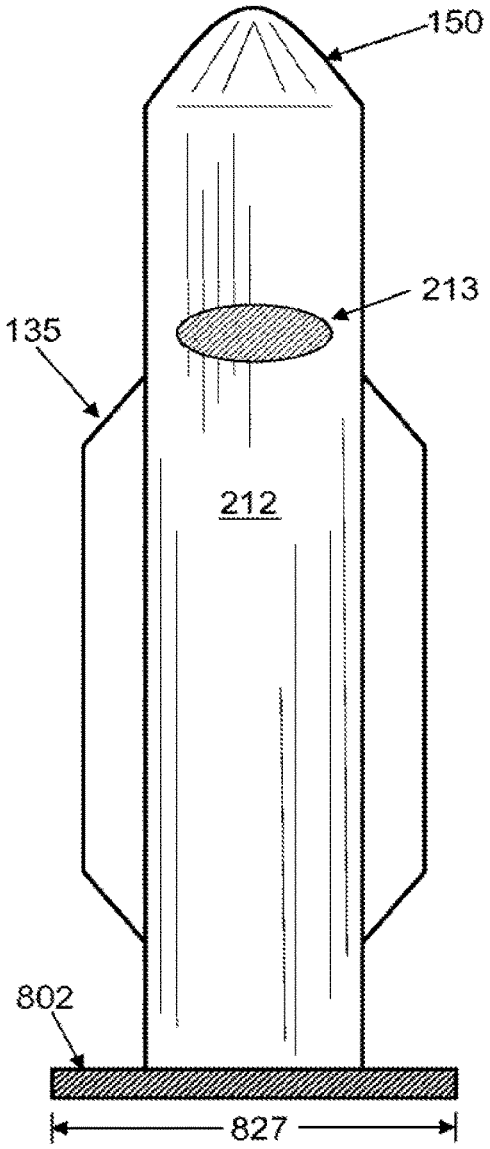
FIG. 8 is a frontal view of a device in accordance with at least one embodiment of the present invention.

FIG. 8 is a frontal view of a device in accordance with at least one embodiment of the present invention. FIG. 8 comprises a rounded top 150. In one embodiment, the rounded top comprises a surface which is not perfectly smooth and can be used to support a fabric laid thereon. By increasing the coefficient of friction of the rounded top, fabrics can be draped atop the machine. In one embodiment, the static coefficient of friction of the top (rounded as shown in FIG. 8 or flat as shown in FIGS. 1-7) is greater than about 0.10 relative to common fabrics like viscose, cotton, and nylon. In one embodiment, the top of the device has a non-smooth finish, for example a corrugated finish, a textured finish (resembling a course sand paper), or has an rough surface coating such as a rubber or silicone coating. Further, FIG. 8 shows an embodiment, wherein the device is supported on a flat base stand 802, having a footprint width of 827. Additionally, the optional handle 213 can have any shape suitable for gripping and pulling. In one embodiment, the element shown in 213 can be a button a user could push to release and/or at least partially eject the extractable drawer from the shell. This button can be a single activation trigger pulling the drawer in and turning the machine on for operation. The extractable drawer can be spring loaded such that it will automatically extend away from the shell when actuated. It is believed that by providing an extractable drawer which is connected to the hanging member, by the single motion of extending the extractable drawer, the hanging member is automatically extracted. Thus no additional step of accessing the interior of the device and/or pulling out a hanging rod is needed. Further, by automatically exposing the hanging member, there is no need for the user to touch or contact any interior contents of the device. The interior contents of the device are likely to form deposits and/or buildups of dust or any dried fabric treatment composition upon repeated use. By decreasing the amount of contact a user needs to make with the interior contents, the use of the device is simplified and becomes more hygienic and clean.

In another embodiment, the cabinet may comprise a user interface which comprises the aggregate means by which users can interact with the device, including, for example, any device or computer program portion of the appliance. In various embodiments, the use interface may comprise an input, an output, or a combination thereof. The input allows the user to enter information into the device 10 to manipulate or control the operation of the appliance. The output allows the device 10 to produce effects for the benefit of the user. In various embodiments, the input and output may comprise visual, audio, and tactile devices. In one embodiment, the input may be configured as a touch keypad and the output may be configured as a display, light emitting indicator, and/or audible alarm.

Figure 9:
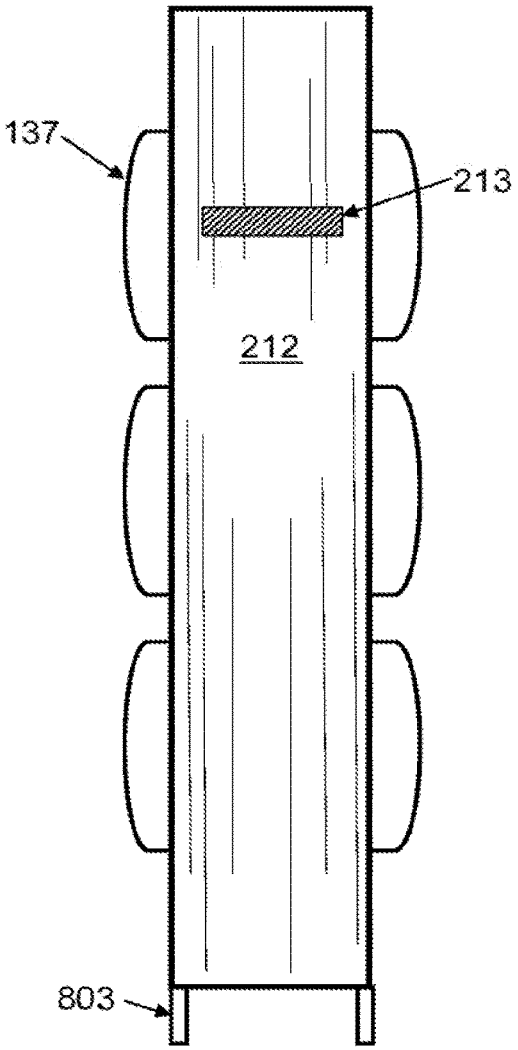
FIG. 9 is a frontal view of a device in accordance with at least one embodiment of the present invention.

In one embodiment, the device further comprises one or more drains (not shown) to allow excess fabric treatment composition to drain out of the cabinet into an optional drain pan (not shown). The drain can be in the form of an aperture formed within the base of said extractable drawer and/or an aperture formed in the lower portions of the shell. In embodiments comprising a second extractable drawer, the drain pan can be positioned with the extractable drawer or below the second extractable drawer such that any excess fabric treatment composition which reaches the drain pan can evaporate similar to a drain pan in a conventional refrigerator or freezer. FIG. 9 is a frontal view of a device in accordance with at least one embodiment of the present invention. As shown in FIG. 9, the side walls of the shell can form a plurality of side protrusions 137. Each of said protrusions preferably contains at least one dispensing head. By providing side protrusions throughout the height of the device, the dispensing heads can efficiently and quickly wet the entire fabric contained within the receiving region of the extractable drawer, on both sides of the fabric. Further, FIG. 9 shows an embodiment wherein the device comprises a base stand 803 which can be wheels or sleds to allow for easy movement and portability of the device.

Figure 11:
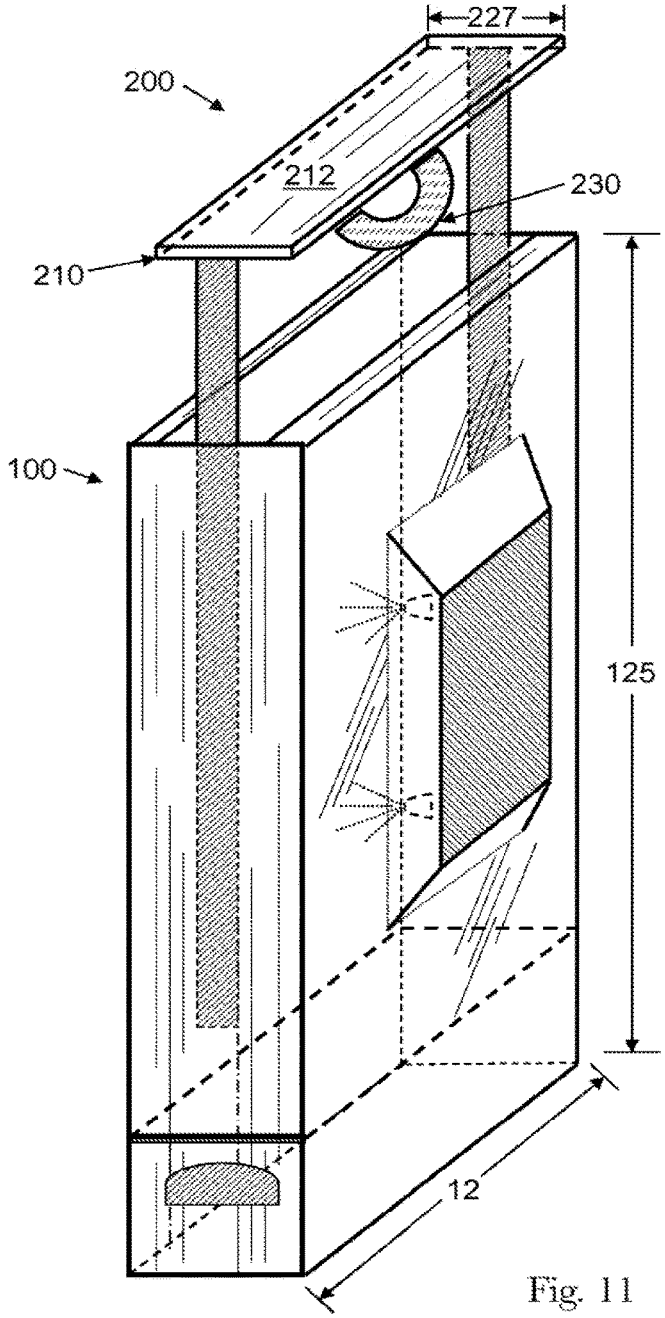
FIG. 11 is a perspective view of a device in accordance with at least one embodiment of the present invention wherein the extractable drawer extends out vertically like in FIG. 10.

FIG. 10 shows a frontal view of a device in accordance with the present invention wherein the device comprises an extractable drawer 200 which opens by extending the drawer in a vertical or upward direction away from the shell 100. Suitable methods to extend the drawer away from the shell (or extract the drawer upwards) include spring loaded members provided within the device or chain driven or leveled mechanisms which can allow for automatic opening. In one embodiment, the extractable drawer is pulled upwards manually. As shown in this figure, extractable drawer 200 comprises a drawer face 210 and has a greatest lateral width of the drawer face of the extractable drawer 227. The device in this embodiment further comprises a greatest lateral width device of 127. FIG. 11 shows a perspective view of a device which also comprises an extractable drawer 200 which opens by extending the drawer in a vertical or upward direction away from the shell 100. Expandable drawer 200 comprises a drawer face 210 having an outer surface 212. As shown in this embodiment, extractable drawer 200 comprises a supporting member 230. Where fabrics are hung off said supporting member in the receiving region, the fabrics will be transported into the interior of the device when the extractable drawer is closed. The device further comprises a depth 12 and a height 125.

Additional optional elements include: one or more visible indicia provided on the exterior of the device to communicate the status of the device during operation; a sound indicator to communicate the status of the device during operation. In one embodiment, the visible indicia comprises a countdown timer, a red/yellow/green status light system, blinking lights which can blink at different rates depending on the status of the operation, or any other light which is conventionally used with home appliances or devices. In another embodiment, the sound indicator wherein the sound indicator is operably connected to a controller so the sound indicia can change depending on the stage; preferably below 70 dB.

In one embodiment, while the device is in operation, the level of noise generated by the device during operation is less than 50 decibels at about 3150 Hz frequency, alternatively at about 4,000 Hz frequency, and alternatively at about 5,000 Hz frequency. Without intending to be bound by theory, it is believed that this level of noise is sufficiently quite that it does not disturb any persons or pets which may be sleeping or resting during operation of the device. This has been found to be particularly important when the device is used in a bedroom or in a closet adjacent to or connected to a bedroom. It is believed that a human is typically sensitive to noises across the audible spectrum of 20 Hz to 20 kHz.

The device is powered by a power source selected from the group consisting of: a solar power member; plug in AC or DC power source; a battery; fuel cell, latent heat accumulator, and combinations thereof.

Suitable Fabric Hanging Members

Fabrics can be placed in the receiving region of the fabric treatment device by any appropriate method known in the art. In one embodiment, one or more fabrics are hung on one or more fabric hanging members. Said fabric hanging members are removably or fixedly attached to said suspending member. In one embodiment, the suspending member is in the form of one or more bars, poles, ropes and so forth, which can be attached to the front face and/or rear face of the extractable drawer. (See e.g. FIG. 1 and FIG. 3.) In another embodiment, the suspending member extends from the drawer face of the extractable drawer. (See e.g. FIG. 10.) In one embodiment, the suspending member suspends more than one fabric hanging members (such as conventional clothing hangers or any other hangers disclosed below). Any suitable fabric hanging member can be used in accordance with the present invention. Preferably, the fabric hanger member is made of a material which is not susceptible to forming rust or melting or deforming within the device while in operation. Non-limiting examples of suitable fabric hanging members are described in EP Pat. Nos. 812556, 670135 and 683999; DE 29713157; U.S. Pat. Nos. 7,328, 822, 6,964,360, 6,817,497, 5,511,701, 5,085,358 and 5,664, 710; US Pub. 2008/00616, 2005/002331 O; and JP 110572999.

In addition to providing a fabric hanging member within the device, in one embodiment, the device further comprises a method to apply tension to the fabrics within the cabinet such that wrinkles are reduced during operation of the device. The fabrics hung within the receiving region of the present device can also be weighted or stretched such that the fabric is under tension, to improve wrinkle reduction. Tensioning systems such as hanging weights and stretching devices are well known to those skilled in the art. See e.g. EP Pat. No. 587173; DE Pat. No. 4435672; and U.S. Pat. No. 5,344,054. Preferably, the fabrics are tensioned after placing them into the container and before starting the process or at the start of the process. This stretching or so-called tensioning of the fabric helps the relaxation of wrinkles during the process and provides a restoring force to the fabric to reestablish an unwrinkled orientation as the device operates.

Preferred stretching systems include weighted as well as lightweight compactable or retractable stretching systems, wherein the system comprises a tensioning device like a spring. The latter systems have the benefit of not adding extra weight to the cleaning and refreshing apparatus, along with the possibility of adjusting tensioning force and direction as required. Preferably, these systems are mounted inside the container at its bottom. One example of such a system is a roller blind that is conventionally used as sun filter for cars and commercially available from Halfords. This system is a roller blind which can be extended or compacted by means of a roll-up spring mechanism. Only slight modification of this system is needed to adapt it to the tensioning of fabric. One preferred adaptation involves attaching the housing of this system at the bottom of the apparatus and providing one or more clamps at the other side so that the clamping and thus the stretching or tensioning of the fabric in the apparatus is obtained. The tension of the spring can also be adjusted to the desired stretching force for a given fabric. The size of the clamp can vary so that more than one clamp is attached to this system. Still, another variation involves having only one clamp which run along or partly along the blind tensioning system located opposite the housing of the system.

In one embodiment, the hanging member and optional tensioning system are movable within said shell. By moving the hanging member and optional tensioning system, the receiving region with any fabrics contained therein can be moved from one side of the device to another, such as in a lateral direction. Moving the fabrics laterally allows for increased distance from the dispensing heads positioned on the interior of the opposite side wall and/or optional protrusion(s). Thus, in one embodiment, the fabrics are moved to one side of the interior of the device while the distribution of the fabric treatment composition is coordinated to emit from the opposite side of the device, for example wetting the front of the fabrics. Correspondingly, the fabrics can be moved to the other side of the device such that the other set of dispensing heads are triggered to wet the other side of the fabrics, such as the back of the fabrics. This increases the lateral distance between the fabric surface being wetted and the dispensing heads allowing for better distribution. The moveable hanging member can be achieved by any mechanical system suitable for use, such as a chain driven system or a gear driven system.

Fabric Treatment Composition

Any conventional liquid and/or fluid fabric treatment composition can be used as a fabric treatment composition without deviating from the present invention. Suitable fabric treatment compositions include any liquid or fluid composition which reduces and/or removes wrinkles, malodors, and/or delivers any other desirable fabric treatment benefits. Additional suitable fabric treatment compositions include perfumes and fragrances which can impart desirable odors upon the fabrics and or into the ambient air where the device is stored. Water, including purified water, tap water and the like are also suitable fabric treatment compositions.

Although the present device is preferably used for refreshing a fabric or garment, such as by reducing malodors and/or wrinkles, it is possible to use a composition which can be stain repellent and/or also assist in the removal of stains, soil, discolorations and/or other undesirable affects from the wearing and use of the fabrics.

In one embodiment, the fabric treatment composition comprises water and optionally a member selected from the group consisting of surfactants, perfumes, preservatives, bleaches, auxiliary cleaning agents, shrinkage reducing compositions, organic solvents, antimicrobial agents, and mixtures thereof. Said fabric treatment composition include both volatile and non-volatile ingredients. Suitable organic solvents are glycol ethers, specifically, methoxy propoxy propanol, ethoxy propoxy propanol, propoxy propoxy propanol, butoxy propoxy propanol, butoxy propanol, ethanol, isopropanol, wrinkle removing agents, in-wear anti-wrinkling agents, semi-durable press agents, odor absorbing agents, volatile silicones and mixtures thereof. Fabric shrinkage reducing compositions that are suitable for use are selected from the group consisting of ethylene glycol, all isomers of propanediol, butanediol, pentanediol, hexanediol and mixtures thereof. In one embodiment, the fabric shrinkage reducing compositions are selected from the group consisting of neopentyl glycol, polyethylene glycol, 1,2-propanediol, 1,3-butanediol, 1-octanol and mixtures thereof. Suitable surfactants include a nonionic surfactant, such as an ethoxylated alcohol or ethoxylated alkyl phenol, and is present at up to about 2%, by weight of the fabric treatment composition. Preferred auxiliary cleaning agents include cyclodextrins and dewrinkling agents, such as silicone containing compounds. Especially preferred anti-wrinkling agents include volatile silicones, some of which can be purchased from the Dow Corning Corporation. One such volatile silicone is D5 cyclomethicone decamethyl cyclopenta siloxane. Typical fabric treatment compositions herein can comprise at least about 80%, by weight, water, preferably at least about 90%, and more preferably at least about 95% water. Non-limiting examples of suitable fabric treatment compositions are provided in U.S. Pat. No. 6,726,186 to Gaaloul et al.

Another suitable fabric treatment composition is the polymer composition having specified pH for improved dispensing and improved stability of wrinkle reducing composition disclosed in U.S. Pat. No. 6,491,840 and the aqueous wrinkle control composition disclosed in U.S. Pat. No. 6,495,058 both references to Frankenbach et al.

In yet another embodiment, the fabric treatment composition U.S. Ser. Nos. 61/130,913 filed Jun. 12, 2008 and 60/993,765 filed Sep. 14, 2007 both to Roselle et al. For example one suitable fabric treatment composition comprises a water soluble quaternary ammonium surfactant, typically the minimum levels of the water soluble quaternary agent included in the composition are at least about 0.01%, preferably at least about 0.05%, more preferably at least about 0.1% while typical maximum levels of water soluble quaternary agent are up to about 20%, preferably less than about 10%, and more preferably less than about 3% and generally in the range of about 0.2% to about 1.0%; a substantially water insoluble oil component or oil mix, wherein the oil components may have a clogP of >1. Typically the minimum levels of the oil component included in the composition are at least about 0.001%, preferably at least about 0.005%, even more preferably at least about 0.01% and typically maximum levels of oil components are up to about 5.0%, preferably less than about 3%, and generally in the range of about 0.05% to about 1%; optional ingredients as disclosed in the two incorporated U.S. patent applications, and balance of water.

Method of Refreshing a Fabric

A method of treating a fabric comprising placing a fabric into the receiving region of the device of claim 1; depositing a fabric treatment composition upon at least a portion of said fabric; actuating said heating element; and venting said device. In one embodiment, the step of depositing said fabric treatment composition comprises dispensing the fabric treatment composition onto the fabrics, such as by spraying, vaporizing, or misting. In one embodiment, the step of actuating said heating element further comprises a step of heating the air within the device to at least about 80° C., alternatively at least about 70° C., alternatively at least about 50° C. Without intending to be bound by theory, it is believed that this application of heat not only helps dry the fabric but also may have odor removal and/or microbial control benefits. Further, where a fabric treatment composition is used which includes antimicrobial agents, the addition of heat may give surprising odor control and anti-microbial benefits to the fabric. In another embodiment, said method of treating said fabric is completed within about 15 minutes, alternatively within about 10 minutes, alternatively within about 8 minutes. In one embodiment, the method further comprises pressing a single button to turn on the device.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern. Except as otherwise noted, the articles "a," "an," and "the" mean "one or more." All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for treating fabrics comprising:
- a cabinet, the cabinet comprising:
  - a shell forming an opening, the shell including first and second sidewalls;
  - an extractable drawer comprising:
    - a drawer face including an outer surface; and
    - a supporting member, wherein the drawer face and the supporting member form a receiving region adapted to operably support a fabric, and wherein the extractable drawer is adapted to fit within the shell and can be extracted through the opening of the shell;
  - a heating element contained with the device;
  - an air flow path positioned to direct air through the receiving region;
  - first and second liquid dispensing heads positioned within the shell on the first sidewall of the shell;
  - third and fourth liquid dispensing heads positioned within the shell on the second sidewall of the shell opposing the first and second liquid dispensing heads; and
  - a base stand supporting the shell and having a width greater than a width of the shell.

2. The device of claim 1, wherein a top wall of the shell is rounded.

3. The device of claim 2, wherein the extractable drawer includes a knob.

4. The device of claim 2, further comprising:
- a ration of the greatest lateral width of the device to the greatest lateral width of the drawer face of the extractable drawer, of from about 9 to about 1.

5. The device of claim 1, wherein the shell includes a pair of sidewalls, wherein at least one of the sidewalls includes at least one side protrusion extending away from the device.

6. The device of claim 5, wherein the extractable drawer is spring-biased to an open position relative to the shell.

7. The device of claim 1, further comprising:
- a source of fabric treatment composition.

8. The device of claim 7, wherein the source of the fabric treatment composition comprises at least one of:
- a reservoir for a fabric treatment composition operably connected to one or more liquid dispensing heads provided within the device, wherein the one or more liquid dispensing heads are oriented to dispense the fabric treatment composition towards the receiving region;
- a detached spray member; and
- a fluid transport member operably connected to a building piping system.

9. The device of claim 1, further comprising:
- a second extractable drawer including a reservoir.

10. A device for treating fabrics comprising:
- a cabinet, the cabinet comprising:
  - a shell forming an opening, the shell including first and second sidewalls;

a first extractable drawer comprising:

a drawer face including an outer surface; and a supporting member, wherein the drawer face and the supporting member form a receiving region adapted to operably support a fabric, and wherein the extractable drawer is adapted to fit within the shell and can be extracted through the opening of the shell;

a heating element contained with the device;

an air flow path positioned to direct air through the receiving region;

first and second liquid dispensing heads positioned within the shell on the first sidewall of the shell;

third and fourth liquid dispensing heads positioned within the shell on the second sidewall of the shell opposing the first and second liquid dispensing heads;

a base stand supporting the shell and having a width greater than a width of the shell;

a source of fabric treatment composition; and a second extractable drawer including a reservoir.

11. The device of claim 10, wherein the air flow path includes an air circulation member operably positioned to direct air through the air flow path and an air filtering system.

12. The device of claim 10, wherein a top wall of the shell is rounded.

13. The device of claim 10, wherein the supporting member includes one or more rods extending from the drawer face to a rear of the shell.

14. The device of claim 10, wherein the heating element includes a heating wire or coil, an infrared lamp, a microwave heating element, and combinations thereof.

15. The device of claim 10, further comprising:

a mechanical tensioning system disposed inside the shell.

16. The device of claim 10, further comprising:

one or more visible indicia provided on the exterior of the device to communicate the status of the device during operation, a sound indicator to communicate the status of the device during operation, or a combination thereof.

17. The device of claim 10, wherein the extractable drawer includes a knob.

18. The device of claim 10, wherein the extractable drawer is spring-biased to an open position relative to the shell.

* * * * *